US012649558B2

(12) United States Patent
Miyagi et al.

(10) Patent No.: US 12,649,558 B2
(45) Date of Patent: Jun. 9, 2026

(54) MARINE PROPULSION SYSTEM, VESSEL, AND CONTROL METHOD

(71) Applicant: YAMAHA HATSUDOKI KABUSHIKI KAISHA, Iwata (JP)

(72) Inventors: Yuta Miyagi, Shizuoka (JP); Morihiko Nanjo, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 324 days.

(21) Appl. No.: 18/523,385

(22) Filed: Nov. 29, 2023

(65) Prior Publication Data

US 2024/0092469 A1 Mar. 21, 2024

Related U.S. Application Data

(63) Continuation-in-part of application No. 17/187,919, filed on Mar. 1, 2021, now Pat. No. 11,866,140.

(30) Foreign Application Priority Data

Mar. 3, 2020 (JP) ..... 2020-036124

(51) Int. Cl.

| | |
|---|---|
| ***B63H 23/00*** | (2006.01) |
| ***B63H 20/14*** | (2006.01) |
| ***B63H 21/17*** | (2006.01) |
| *B63H 20/00* | (2006.01) |

(52) U.S. Cl.

CPC ..... *B63H 20/14* (2013.01); *B63H 21/17* (2013.01); *B63H 23/00* (2013.01); *B63H 2020/003* (2013.01)

(58) Field of Classification Search

CPC ..... B63H 20/14; B63H 21/17; B63H 23/00; B63H 2020/003

See application file for complete search history.

(56) References Cited

U.S. PATENT DOCUMENTS

2018/0170502 A1* 6/2018 Terada ..... G05D 1/0016
2022/0258845 A1* 8/2022 Sawano ..... B63H 21/20

OTHER PUBLICATIONS

Miyagi et al., "Marine Propulsion System and Control Method", U.S. Appl. No. 17/187,919, filed Mar. 1, 2021.

* cited by examiner

*Primary Examiner* — Mathew Franklin Gordon
(74) *Attorney, Agent, or Firm* — Keating & Bennett, LLP

(57) ABSTRACT

A marine propulsion system includes a first marine propulsion device and a second marine propulsion device. The first marine propulsion device includes an engine, a first propeller shaft to receive a driving force from the engine, and a first controller configured or programmed to control the engine. The second marine propulsion device includes an electric motor, a second propeller shaft to receive a driving force from the electric motor, an electric circuit connected to the electric motor to drive the electric motor, and a second controller configured or programmed to control the electric motor. The first controller is configured or programmed to put a limitation on an output of the engine when the electric motor is not being driven.

25 Claims, 9 Drawing Sheets

MARINE PROPULSION SYSTEM, VESSEL, AND CONTROL METHOD

CROSS REFERENCE TO RELATED APPLICATIONS

This application claims the benefit of priority to Japanese Patent Application No. 2020-036124 filed on Mar. 3, 2020. The entire contents of this application are hereby incorporated herein by reference.

BACKGROUND OF THE INVENTION

1. Field of the Invention

The present invention relates to a marine propulsion system, vessel, and a control method thereof.

2. Description of the Related Art

There has been conventionally known a type of marine propulsion system including both an engine and an electric motor as mechanical power sources for rotating a propeller shaft of a watercraft (see Japan Laid-open Patent Application Publication No. 2017-218016). The marine propulsion system is configured to rotate the propeller shaft only by a drive force of the electric motor in an extremely low speed range and is also configured to rotate the propeller shaft by a drive force of the engine at a predetermined speed or greater. The electric motor is supplied with electric power from a battery through an electric circuit such as an inverter.

There has also been known a type of watercraft including a plurality of marine propulsion devices as disclosed in Japan Laid-open Patent Application Publication No. 2014-148273.

For example, when three marine propulsion devices, each of which is of the type disclosed in Japan Laid-open Patent Application Publication No. 2017-218016, are mounted to a watercraft, an operator propels the watercraft depending on situations by powering on only two marine propulsion devices located on both starboard and port sides and by powering off the remaining marine propulsion device located in the middle of the two marine propulsion devices. At this time, the following can be assumed in the middle marine propulsion device: induced voltage is generated by an electric motor when entrained rotation of the electric motor occurs through a propeller rotated by driving of the two marine propulsion devices. In the marine propulsion device kept powered off, not only the electric motor but also an electric circuit such as an inverter is not supplied with electric power. Thus, the electric motor and the electric circuit are uncontrolled. As a result, the electric circuit cannot be protected from the induced voltage generated by entrained rotation of the electric motor. Additionally, there is a concern that the electric motor is adversely affected by heat generated due to the induced voltage.

SUMMARY OF THE INVENTION

Preferred embodiments of the present invention protect electric circuits and electric motors from induced voltage generated by entrained rotation of the electric motors in marine propulsion systems each including a plurality of marine propulsion devices.

A marine propulsion system according to a first preferred embodiment of the present invention includes a first marine propulsion device and a second marine propulsion device.

The first marine propulsion device includes an engine, a first propeller shaft to which a driving force of the engine is transmitted, and a first controller configured or programmed to control the engine. The second marine propulsion device includes an electric motor, a second propeller shaft to which a driving force of the electric motor is transmitted, an electric circuit connected to the electric motor, and a second controller configured or programmed to control the electric motor. The first controller is configured or programmed to put a limitation on an output of the engine when the electric motor is not being driven.

A marine propulsion system according to a second preferred embodiment of the present invention includes a plurality of marine propulsion devices. Each of the marine propulsion devices includes an electric motor, a propeller shaft to which a driving force of the electric motor is transmitted, an electric circuit connected to the electric motor, and a controller configured or programmed to control the electric motor. In each of the plurality of marine propulsion devices, the controller is configured or programmed to put a limitation on an output of the electric motor that is in a driving state when an electric motor in any other of the plurality of marine propulsion devices is not being driven.

A control method according to a third preferred embodiment of the present invention relates to a method of controlling a marine propulsion system. The marine propulsion system includes a first marine propulsion device and a second marine propulsion device. The first marine propulsion device includes an engine, a first propeller shaft to which a driving force of the engine is transmitted, and a first controller configured or programmed to control the engine. The second marine propulsion device includes an electric motor, a second propeller shaft to which a driving force of the electric motor is transmitted, an electric circuit connected to the electric motor, and a second controller configured or programmed to control the electric motor. The method includes determining whether or not the electric motor is being driven, and putting a limitation on an output of the engine when the electric motor is not being driven.

A control method according to a fourth preferred embodiment of the present invention relates to a method of controlling a marine propulsion system. The marine propulsion system includes a plurality of marine propulsion devices, each including an electric motor, a propeller shaft to which a driving force of the electric motor is transmitted, an electric circuit connected to the electric motor, and a controller configured or programmed to control the electric motor. The method includes determining whether or not the electric motors of the plurality of marine propulsion devices are being driven, and putting a limitation on an output of the electric motor that is in a driving state when an electric motor in any other of the plurality of marine propulsion devices is not being driven.

According to the marine propulsion systems and control methods in preferred embodiments of the present invention, when the controller is set in the communicable state, the controller puts a limitation on the output of the engine or the electric motor that is in a driving state when it is determined that the controller is incommunicable with any other of the controllers of the marine propulsion device including the electric motor. In other words, the output of the engine or the electric motor is limited when a controller in any other of the plurality of marine propulsion devices including the electric motor is not supplied with electric power. Accordingly, a watercraft is limited in propulsion speed. Thus, even when entrained rotation of the electric motor is caused while the controller is not supplied with electric power in any of the plurality of marine propulsion devices, an increase in the rotational speed of the electric motor is prevented. As a result, induced voltage generated by the electric motor is prevented. Thus, the electric circuit and the electric motor is protected from the induced voltage generated by entrained rotation of the electric motor in any of the plurality of marine propulsion devices.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
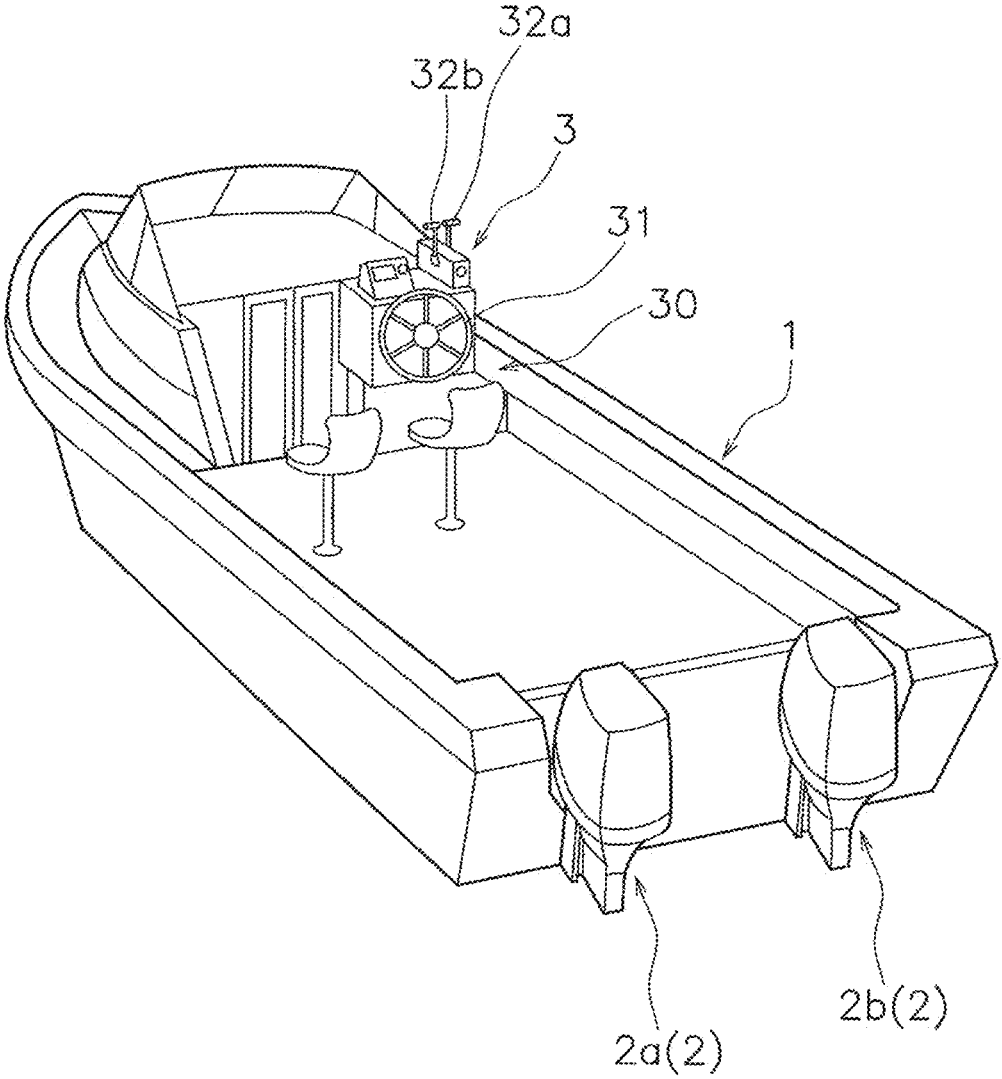
FIG. 1 is a perspective view of a watercraft including a marine propulsion system.
Figure 2:
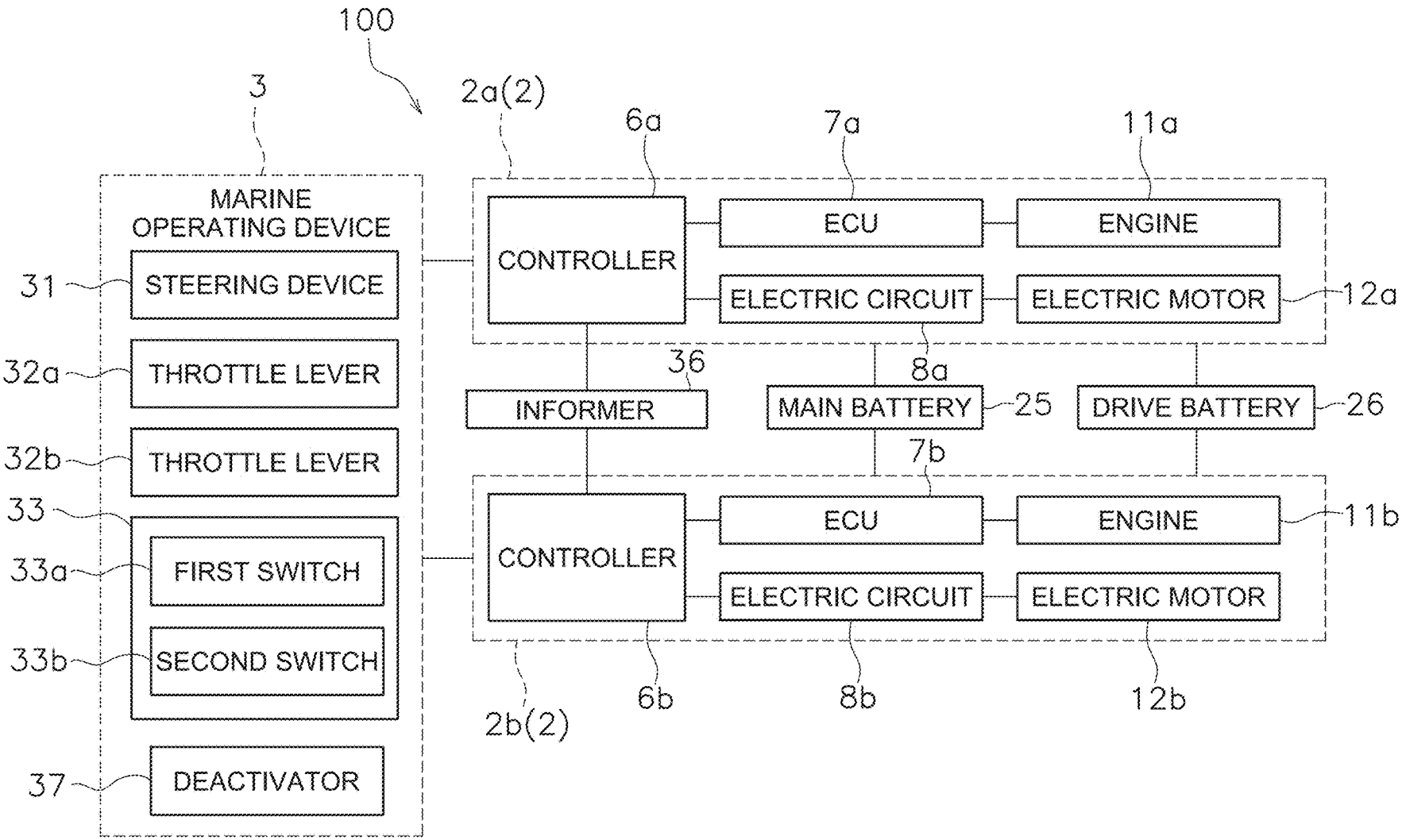
FIG. 2 is a block diagram showing a configuration of the marine propulsion system.

Preferred embodiments will be hereinafter explained with reference to drawings. FIG. 1 is a perspective view of a watercraft 1 including a marine propulsion system 100 according to a first preferred embodiment of the present invention. FIG. 2 is a block diagram showing a configuration of the marine propulsion system 100. The marine propulsion system 100 includes a plurality of outboard motors 2 and a marine operating device 3.

Each outboard motor 2 generates a thrust to propel the watercraft 1. Each outboard motor 2 is an exemplary marine propulsion device. In the present preferred embodiment, the outboard motor 2 attached to a port portion of the stern of the watercraft 1 will be referred to as a first outboard motor 2*a*, whereas the outboard motor 2 attached to a starboard portion of the stern of the watercraft 1 will be referred to as a second outboard motor 2*b*.

Figure 3:
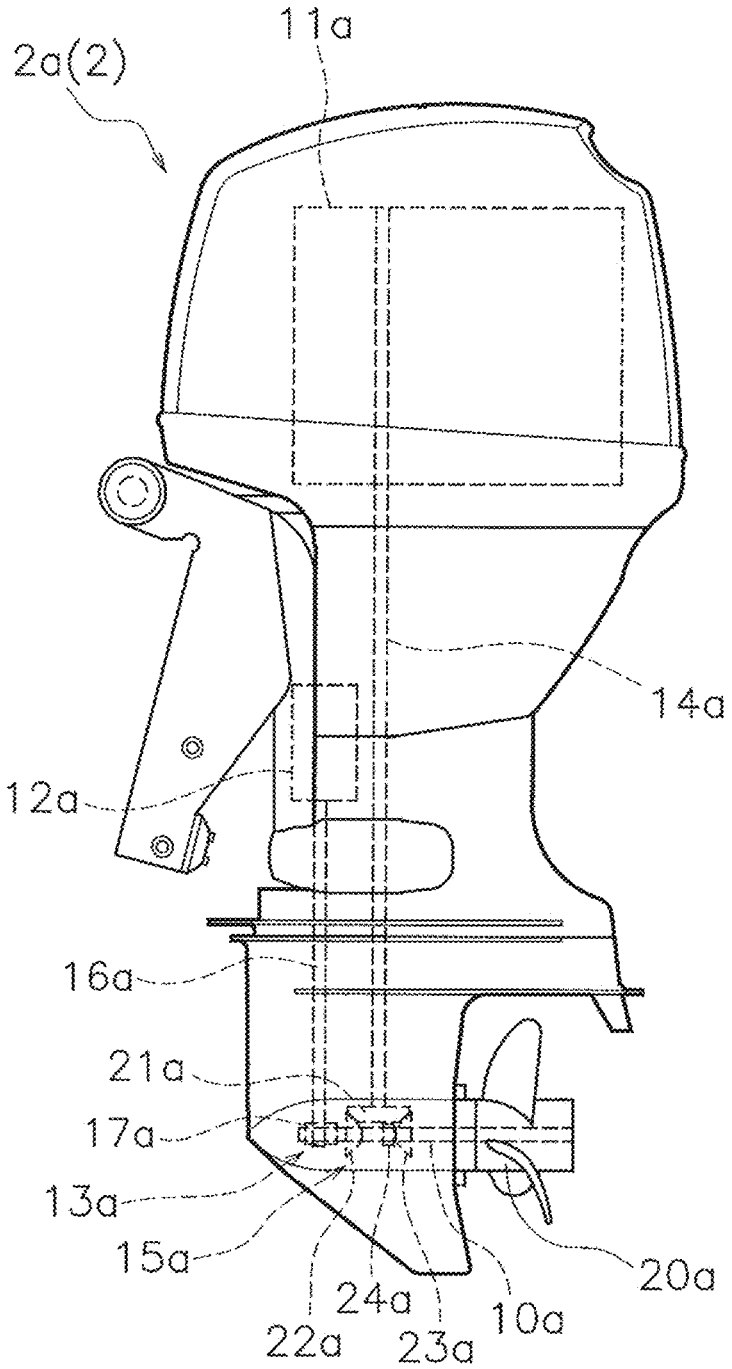
FIG. 3 is a side view of an outboard motor.

FIG. 3 is a side view of the first outboard motor 2*a*. The first outboard motor 2*a* includes a propeller shaft 10*a*, an engine 11*a*, an electric motor 12*a*, and a power transmission 13*a*. It should be noted that the second outboard motor 2*b* has a similar structure to the first outboard motor 2*a*.

The propeller shaft 10*a* extends in the back-and-forth direction of the watercraft 1. A propeller 20*a* is attached to the propeller shaft 10*a* and is unitarily rotated therewith. Each of the engine 11*a* and the electric motor 12*a* is a mechanical power source that generates the thrust to propel the watercraft 1.

The power transmission 13*a* transmits mechanical power to the propeller shaft 10*a* from at least one of the engine 11*a* and the electric motor 12*a*. The power transmission 13*a* includes a drive shaft 14*a*, an engine clutch 15*a*, a motor shaft 16*a*, and a motor clutch 17*a*.

The drive shaft 14*a* extends in the vertical direction. The drive shaft 14*a* is rotated when driven by the engine 11*a*. The engine clutch 15*a* connects or disconnects the drive shaft 14*a* and the propeller shaft 10*a* to or from each other. Additionally, the engine clutch 15*a* switches between rotational directions of the propeller shaft 10*a*.

The engine clutch 15*a* includes a drive gear 21*a*, a forward moving gear 22*a*, a rearward moving gear 23*a*, and a dog clutch 24*a*. The drive gear 21*a* is rotated unitarily with the drive shaft 14*a*. The forward moving gear 22*a* and the rearward moving gear 23*a* are meshed with the drive gear 21*a*. Rotation of the drive shaft 14*a* is transmitted to the forward moving gear 22*a* and the rearward moving gear 23*a* through the drive gear 21*a*. The dog clutch 24*a* is movable to a forward moving position, a neutral position, and a rearward moving position.

When the dog clutch 24*a* is in the forward moving position, the forward moving gear 22*a* is connected to the propeller shaft 10*a*, such that rotation of the drive shaft 14*a* is transmitted to the propeller shaft 10*a* through the forward moving gear 22*a*. When the dog clutch 24*a* is in the neutral position, the propeller shaft 10*a* is disconnected from the forward moving gear 22*a* and the rearward moving gear 23*a*, such that rotation of the drive shaft 14*a* is not transmitted to the propeller shaft 10*a*. When the dog clutch 24*a* is in the rearward moving position, the rearward moving gear 23*a* is connected to the propeller shaft 10*a*, such that rotation of the drive shaft 14*a* is transmitted to the propeller shaft 10*a* through the rearward moving gear 23*a*.

The motor shaft 16*a* extends parallel or substantially parallel to the drive shaft 14*a*. The motor shaft 16*a* is rotated when driven by the electric motor 12*a*. The motor clutch 17*a* connects or disconnects the motor shaft 16*a* and the propeller shaft 10*a* to or from each other. The motor clutch 17*a* is movable to a connecting position or a disconnecting position. When the motor clutch 17*a* is in the connecting position, rotation of the motor shaft 16*a* is transmitted to the propeller shaft 10*a* through a motor gear (not shown in the drawings). When the motor clutch 17*a* is in the disconnecting position, the propeller shaft 10*a* is disconnected from the motor gear, such that rotation of the motor shaft 16*a* is not transmitted to the propeller shaft 10*a*.

As shown in FIG. 2, the first outboard motor 2*a* includes a controller 6*a*, an ECU (Electric Control Unit) 7*a*, and an electric circuit 8*a*. The controller 6*a* is configured or programmed to control the first outboard motor 2*a*. The controller 6*a* includes a processor such as a CPU (Central Processing Unit) and memories such as a RAM (Random Access Memory) and a ROM (Read Only Memory). The controller 6*a* stores programs and data to control the first outboard motor 2*a*.

The controller 6*a* controls movement of the engine clutch 15*a* and the motor clutch 17*a* through actuators (not shown in the drawings) in accordance with an operating signal transmitted thereto from the marine operating device 3. The controller 6*a* controls driving and output of the engine 11*a* and/or the electric motor 12*a* in accordance with the operating signal transmitted thereto from the marine operating device 3. It should be noted that in the present preferred embodiment, the controller 6*a* controls the engine clutch 15*a* and the engine 11*a* through the ECU 7*a*. The controller 6*a* may be located inside the first outboard motor 2*a*, or alternatively, may be located outside the first outboard motor 2*a*.

The ECU 7*a* controls the engine clutch 15*a* and the engine 11*a* based on a command issued by the controller 6*a*. For example, the ECU 7*a* controls the action of the engine clutch 15*a* and driving and output of the engine 11*a* in accordance with the command issued by the controller 6*a*. The ECU 7*a* includes a processor such as a CPU and memories such as a RAM and a ROM.

The electric circuit 8*a* is a motor drive circuit and is connected to the electric motor 12*a*. The electric circuit 8*a* includes an inverter, for instance, and converts a direct voltage inputted thereto from a drive battery 26 (to be described below) into an alternating voltage and outputs the alternating voltage to the electric motor 12*a*. The electric circuit 8*a* also includes a capacitor and a plurality of switching elements. The electric circuit 8*a* controls the driving and output of the electric motor 12*a* in accordance with a command issued by the controller 6*a*.

A main battery 25 and the drive battery 26 to drive the electric motor 12*a* are connected to the first outboard motor 2*a*. The main battery 25 and the drive battery 26 are exemplary batteries.

For example, the main battery 25 is a lead battery of 12V and supplies electric power to the first outboard motor 2*a*. The drive battery 26 is a lead battery of 36V, for example, and supplies electric power to the electric circuit 8*a*. The drive battery 26 includes, for instance, three lead batteries of 12V connected in series. It should be noted that in the present preferred embodiment, both the main battery 25 and the drive battery 26 are able to supply electric power to the electric circuit 8*a*.

The first outboard motor 2*a* is provided with an electric power generator to generate electric power when driven by the engine 11*a*. The electric power generated by the electric power generator is supplied to the main battery 25 and the drive battery 26. The electric power generator includes, for instance, a rotor and a stator. The electric power generator generates electric power when the rotor connected to the drive shaft 14*a* is rotated with respect to the stator. It should be noted that the electric power, generated by the electric power generator, is supplied to the drive battery 26, for instance, after being rectified and controlled in voltage by a rectifier voltage regulator and further being increased in voltage to 36V, for example, by a DC/DC converter.

As shown in FIG. 2, similarly to the first outboard motor 2*a*, the second outboard motor 2*b* includes a controller 6*b*, an ECU 7*b*, an engine 11*b*, an electric circuit 8*b*, and an electric motor 12*b*. The main battery 25 and the drive battery 26 are connected to the second outboard motor 2*b*. It should be noted that the configuration of the second outboard motor 2*b* is similar to that of the first outboard motor 2*a*, and thus, the detailed explanation thereof will be omitted.

The controller 6*a* of the first outboard motor 2*a* and the controller 6*b* of the second outboard motor 2*b* are connected through wireless communication. The controllers 6*a* and 6*b* of the first and second outboard motors 2*a* and 2*b* are communicable with each other, while each is supplied with electric power from the main battery 25. It should be noted that the controllers 6*a* and 6*b* of the first and second outboard motors 2*a* and 2*b* may be connected through wired communication.

The marine operating device 3 is located in a cockpit 30 on the watercraft 1. As shown in FIG. 2, the marine operating device 3 includes a steering device 31, throttle levers 32*a* and 32*b*, and a plurality of switches 33. The steering device 31 operates the turning direction of the watercraft 1. The throttle lever 32*a* regulates a thrust generated by the first outboard motor 2*a* and switches the direction of the thrust between forward and rearward directions. The throttle lever 32*b* regulates a thrust generated by the second outboard motor 2*b* and switches the direction of the thrust between forward and rearward directions.

The plurality of switches 33 include a switch to start each engine 11*a*, 11*b*, a switch to set the vessel speed, and a switch to switch each outboard motor 2*a*, 2*b* among drive modes. Additionally, the plurality of switches 33 include a first switch 33*a* and a second switch 33*b*. The first switch 33*a* connects or disconnects the main battery 25 and both the electric circuit 8*a* and the controller 6*a* to or from each other. The second switch 33*b* connects or disconnects the main battery 25 and both the electric circuit 8*b* and the controller 6*b* to or from each other. For example, the first and second switches 33*a* and 33*b* may be rotary switches. The first and second switches 33*a* and 33*b* may be located in remote positions from the cockpit 30. The first and second switches 33*a* and 33*b* are exemplary switches.

When the first switch 33*a* is closed and turned to an on state, electric power is supplied to the first outboard motor 2*a* from the main battery 25 and the drive battery 26. When the first switch 33*a* is opened and turned to an off state, the main battery 25 and the drive battery 26 are blocked from being connected to the first outboard motor 2*a*. When the first switch 33*a* is in the off state, the controller 6*a* is not supplied with electric power, and thus, is incommunicable with the controller 6*b* of the second outboard motor 2*b*.

Likewise, when the second switch 33*b* is closed and turned to an on state, electric power is supplied to the second outboard motor 2*b* from the main battery 25 and the drive battery 26. When the second switch 33*b* is opened and turned to an off state, the main battery 25 and the drive battery 26 are blocked from being connected to the second outboard motor 2*b*. When the second switch 33*b* is in the off state, the controller 6*b* is not supplied with electric power, and thus, is incommunicable with the controller 6*a* of the first outboard motor 2*a*.

Figure 4:
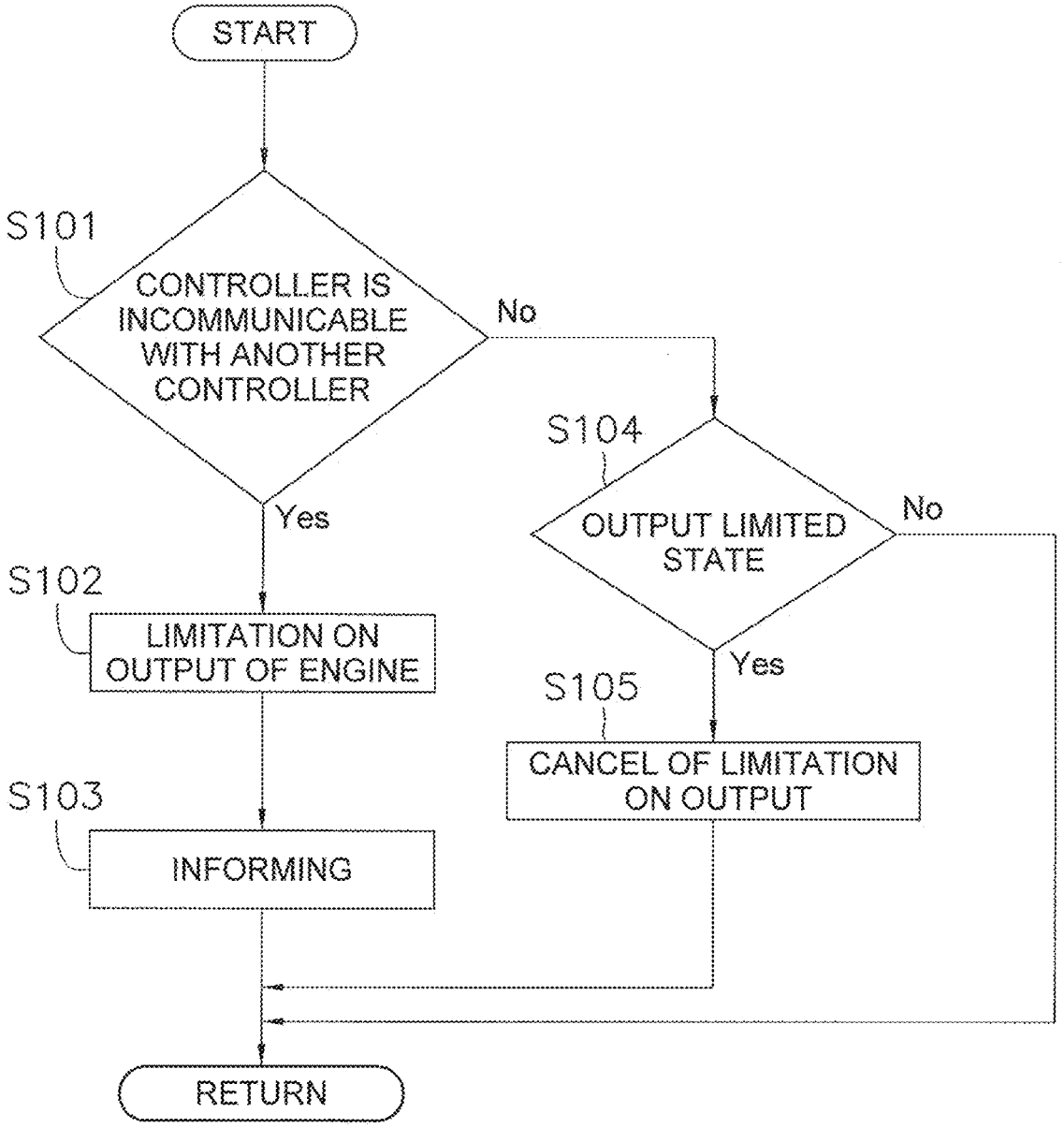
FIG. 4 is a flowchart showing a series of control processes to limit an output of an engine.

Next, a series of control processes to be executed by the controller 6*a* will be explained with reference to FIG. 4. FIG. 4 is a flowchart showing a series of control processes to limit the output of the engine 11*a* to be executed by the controller 6*a* when the controller 6*a* is supplied with electric power. It should be noted that the controller 6*b* also executes a series of control processes similar to that executed by the controller 6*a*.

In step S101, the controller 6*a* determines whether or not the controller 6*a* is incommunicable with another controller (herein, the controller 6*b*). When it is determined that the controller 6*a* is incommunicable with the controller 6*b*, the controller 6*a* executes the process of step S102. In step S102, the controller 6*a* limits the output of the engine 11*a*.

Specifically, when the controller 6*a* is incommunicable with the controller 6*b*, the controller 6*a* limits the rotational speed of the propeller 20*a* by limiting the output of the engine 11*a* to prevent induced voltage, generated by entrained rotation of the electric motor 12*b* in the second outboard motor 2*b*, from exceeding a voltage proof (of, e.g., about 63V) of the capacitor of the electric circuit 8*b*. The controller 6*a* limits the output of the engine 11*a*, for instance, to prevent the rotational speed of the propeller 20*a* from exceeding about 1500 rpm, for example. Alternatively, the controller 6*a* limits the output of the engine 11*a*, for instance, to prevent the rotational speed of the electric motor 12*b* due to the entrained rotation from exceeding about 4000 rpm, for example.

In step S103, the controller 6*a* informs a watercraft operator that an output limited state of the engine 11*a* is activated. In the output limited state, a limitation is put on the output of the engine 11*a*. As shown in FIG. 2, the marine propulsion system 100 may herein further include an informer 36. The controller 6*a* informs the watercraft operator that the output limited state of the engine 11*a* is activated by, for example, sound, light, an indication displayed on a display device, or so forth through the informer 36. Afterward, the controller 6*a* repeatedly executes the series of processes from step S101.

The informer 36 included in the marine propulsion system 100 enables the watercraft operator to easily notice that the output limited state of the engine 11*a* is activated. In this case, when it is noticed that the second switch 33*b* is in the off state by checking the state of the second switch 33*b*, the watercraft operator is able to deactivate the output limited state of the engine 11*a* by turning the second switch 33*b* to the on state.

In step S101, when it is determined that the controller 6*a* is communicable with the controller 6*b*, the controller 6*a* executes the process of step S104.

In step S104, the controller 6*a* determines whether or not the output limited state of the engine 11*a* is activated. When it is determined that the output limited state of the engine 11*a* is activated, the controller 6*a* executes the process of step S105.

In step S105, the controller 6*a* cancels the limitation put on the output of the engine 11*a*. At this time, the controller 6*a* stops the informer 36 from executing the informing process. Afterward, the controller 6*a* repeatedly executes the series of processes from step S101.

When it is determined that the output limited state of the engine 11*a* is not activated in step S104, the controller 6*a* repeatedly executes the series of processes from step S101.

As shown in FIG. 2, the marine propulsion system 100 may further include a deactivator 37. For example, the deactivator 37 includes a switch. When operated, the deactivator 37 outputs a deactivation signal to deactivate the output limited state of the engine 11*a*, 11*b* to the controller 6*a*, 6*b*.

Figure 5:
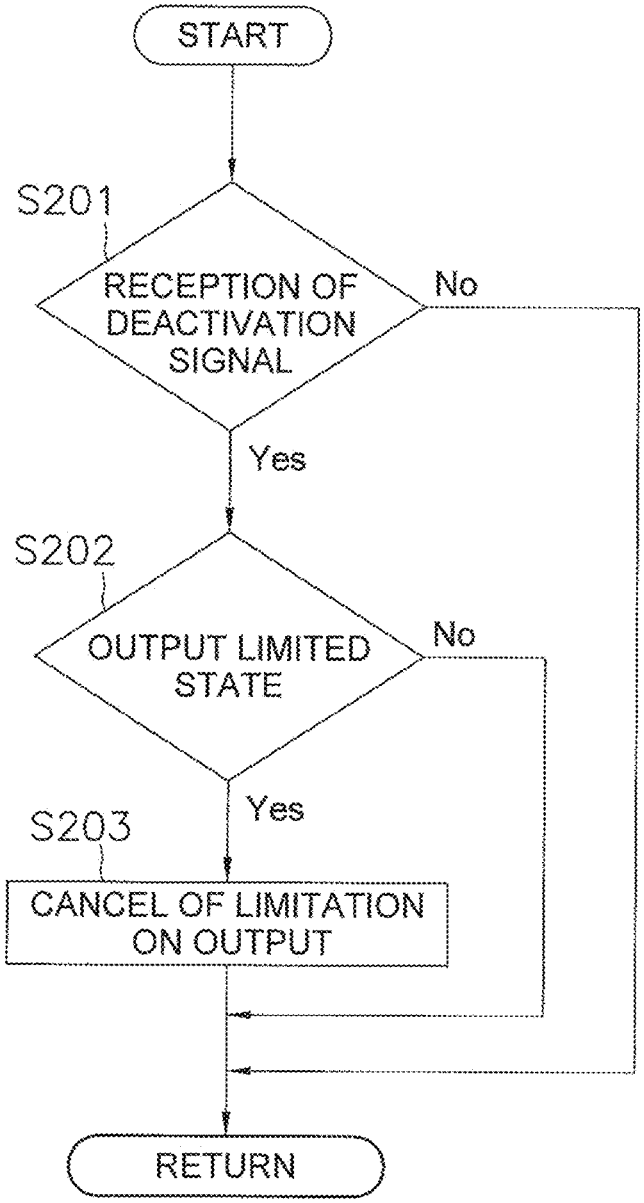
FIG. 5 is a flowchart showing a series of control processes to deactivate an output limited state of the engine.

FIG. 5 is a flowchart exemplifying a series of control processes to deactivate the output limited state of the engine 11*a* to be executed by the controller 6*a*. It should be noted that the controller 6*b* also executes a series of control processes similar to the series of control processes herein executed by the controller 6*a*.

In step S201, the controller 6*a* determines whether or not the controller 6*a* has received the deactivation signal from the deactivator 37. When it is determined that the controller 6*a* has received the deactivation signal, the controller 6*a* executes the process of step S202.

In step S202, the controller 6*a* determines whether or not the output limited state of the engine 11*a* is activated. When it is determined that the output limited state of the engine 11*a* is activated, the controller 6*a* executes the process of step S203.

In step S203, the controller 6*a* cancels the limitation put on the output of the engine 11*a*. At this time, the controller 6*a* stops the informer 36 from executing the informing process. It should be noted that the process of deactivating the output limited state of the engine 11*a* is not executed when the controller 6*a* determines that the controller 6*a* has not received the deactivation signal in step S201 and when the controller 6*a* determines that the output limited state of the engine 11*a* is not activated in step S202.

In the marine propulsion system 100 described above, the controller 6*a* puts a limitation on the output of the engine 11*a*, for instance, when the controller 6*a* is incommunicable with the controller 6*b* and while the controller 6*a* is being supplied with electric power from the main battery 25. Alternatively, the controller 6*b* puts a limitation on the output of the engine 11*b* when the controller 6*b* is incommunicable with the controller 6*a* while the controller 6*b* is being supplied with electric power. When either the controller 6*a* or the controller 6*b* is not supplied with electric power, a limitation is put on either the output of the engine 11*a* or that of the engine 11*b*. Accordingly, a limitation is put on the propulsion speed of the watercraft 1. Thus, when the controller 6*b* is not being supplied with electric power, for instance, an increase in the rotational speed of the electric motor 12*b* due to the entrained rotation is prevented. As a result, the electric circuit 8*b* and the electric motor 12*b* are protected from induced voltage generated by entrained rotation of the electric motor 12*b*.

Incidentally, when the second outboard motor 2*b* is tilted up, for instance, entrained rotation of the electric motor 12*b* is not caused. Thus, even when the second switch 33*b* is kept in the off state, if the marine propulsion system 100 includes the deactivator 37, the output limited state of the engine 11*a* is deactivated by operating the deactivator 37.

Figure 6:
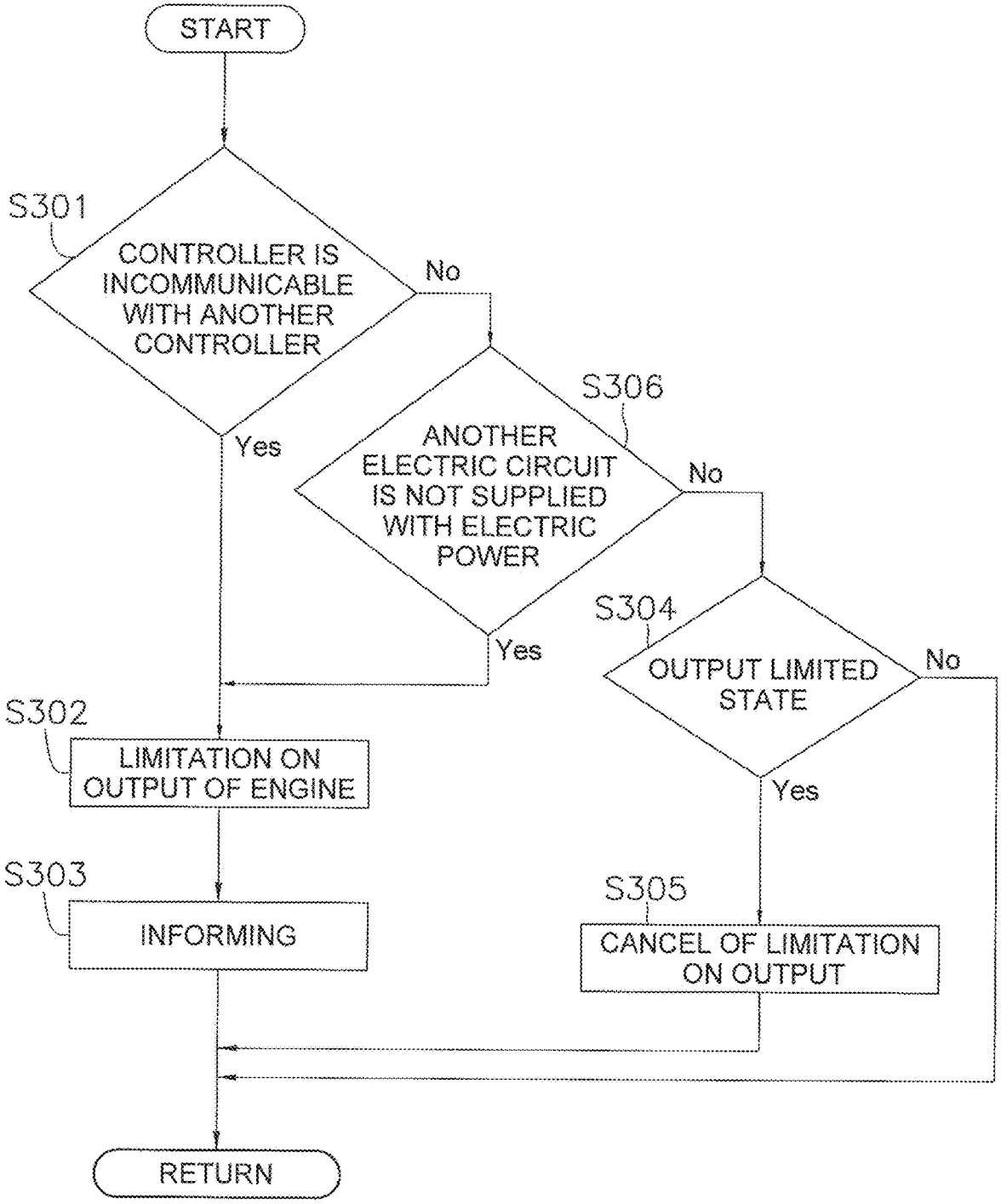
FIG. 6 is a flowchart showing another series of control processes to limit the output of the engine.

FIG. 6 is a flowchart showing a series of control processes to be executed by the controller 6*a* according to a second preferred embodiment of the present invention. In the second preferred embodiment, the controller 6*a* limits the output of the engine 11*a* when it is communicable (No in S301) with another controller (herein, the controller 6*b*) but another electric circuit (herein, the electric circuit 8*b*) is not being supplied with electric power (Yes in S306). It should be noted that the series of control processes to be executed by the controller 6*a* as shown in FIG. 6 is obtained by adding the process of step S306 to that in the first preferred embodiment, and is, except for this, similar to that in the first preferred embodiment. Therefore, the series of processes including steps S301 to S305 is similar to that of steps S101 to S105 shown in FIG. 4, and explanation thereof will be hereinafter omitted.

In step S301, when it is determined that the controller 6*a* is communicable with the controller 6*b*, the controller 6*a* executes the process of step S306. In step S306, the controller 6*a* obtains information regarding the electric circuit 8*b* from the controller 6*b* and determines whether or not the electric circuit 8*b* is not being supplied with electric power. When it is determined that the electric circuit 8*b* is not being supplied with electric power, the controller 6*a* puts a limitation on the output of the engine 11*a* (step S302). When it is determined that the electric circuit 8*b* is supplied with electric power, the controller 6*a* executes the process of step S304.

Figure 7:
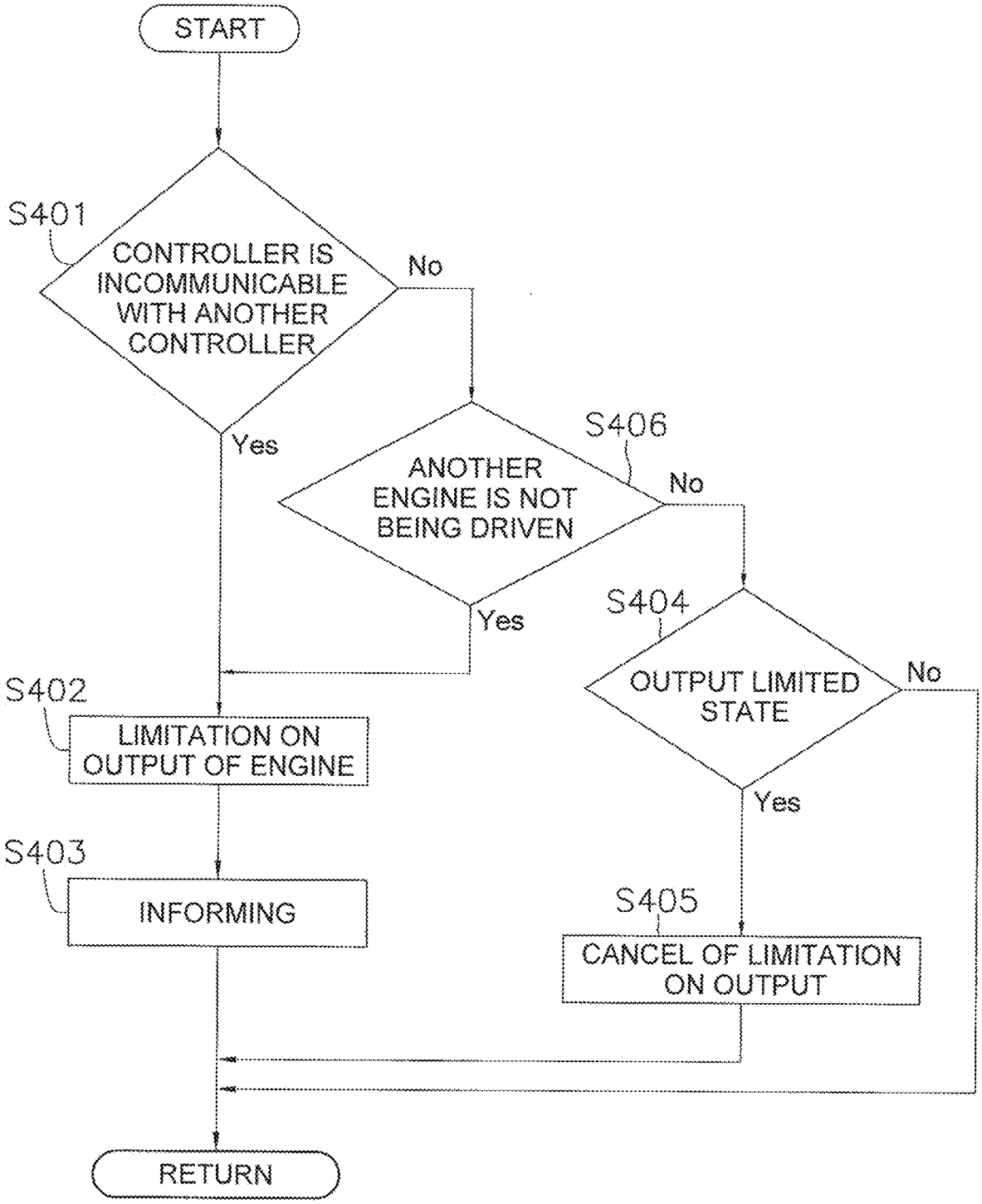
FIG. 7 is a flowchart showing yet another series of control processes to limit the output of the engine.

FIG. 7 is a flowchart showing a series of control processes to be executed by the controller 6*a* according to a third preferred embodiment of the present invention. In the third preferred embodiment, the controller 6*a* limits the output of the engine 11*a* when another engine (herein, the engine 11*b*) is not being driven. It should be noted that the series of control processes to be executed by the controller 6*a* as shown in FIG. 7 is obtained by adding the process of step S406 to that in the first preferred embodiment and is, except for this, similar to that in the first preferred embodiment. Therefore, the series of processes of steps S401 to S405 is similar to that of steps S101 to S105 shown in FIG. 4, and explanation thereof will be hereinafter omitted.

In step S401, when it is determined that the controller 6*a* is communicable with the controller 6*b*, the controller 6*a* executes the process of step S406. In step S406, the controller 6*a* obtains information regarding the engine 11*b* from the controller 6*b* and determines whether or not the engine 11*b* is not being driven.

In step S406, when it is determined that the engine 11*b* is not being driven, the controller 6*a* puts a limitation on the output of the engine 11*a* (S402). It should be noted that, when it is determined that the controller 6*a* is incommunicable with the controller 6*b* in step S401, the engine 11*b* is in an undriven or substantially undriven state in which the controller 6*a* puts a limitation on the output of the engine 11*a*.

Figure 8:
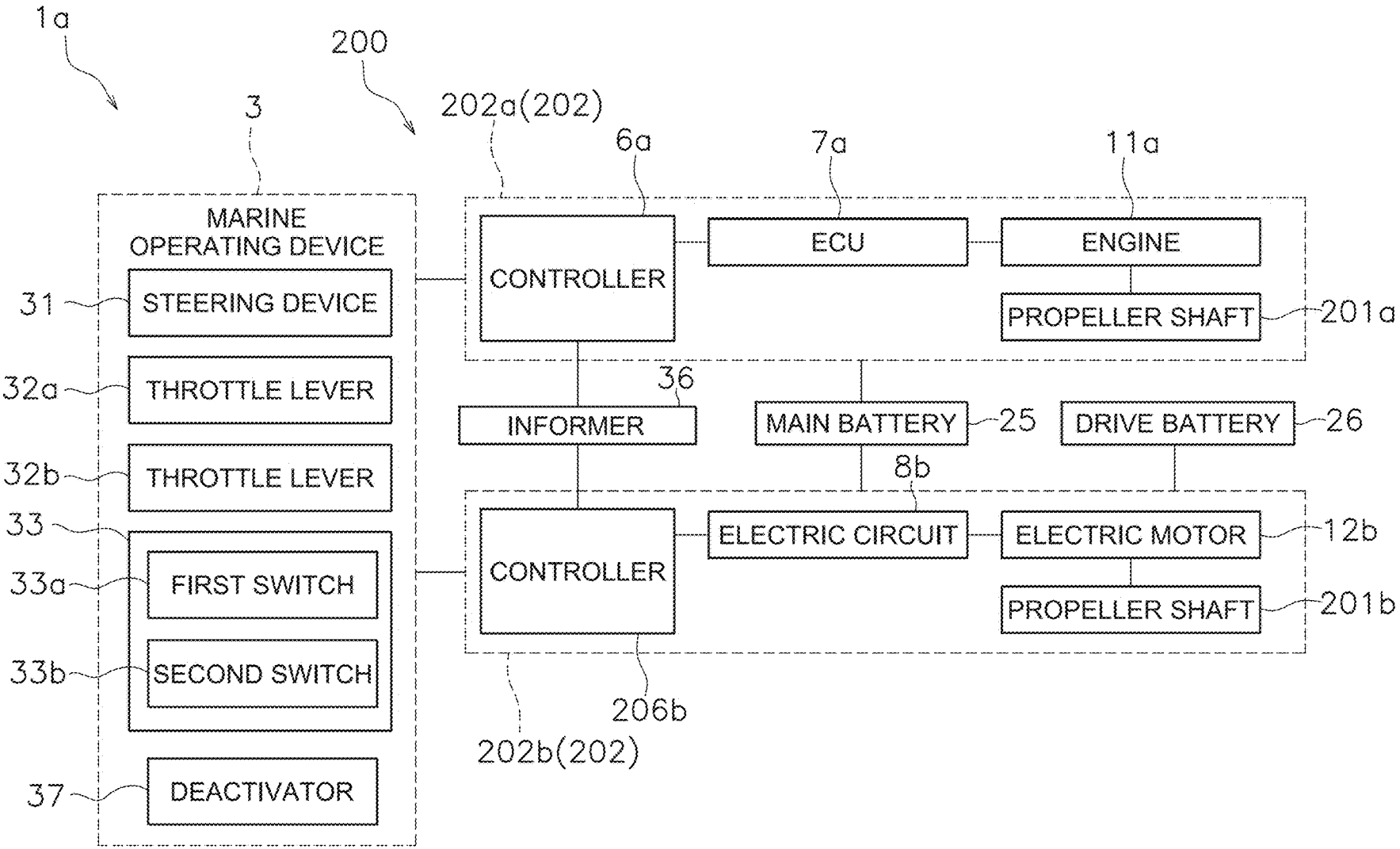
FIG. 8 is a block diagram showing a configuration of the marine propulsion system according to a fourth preferred embodiment of the present invention.

FIG. 8 is a block diagram showing a configuration of a marine propulsion system 200 according to a fourth preferred embodiment. The marine propulsion system 200 has the same configuration as the marine propulsion system 100, except that the first outboard motor 2*a* does not include the electric circuit 8*a* and the electric motor 12*a*, and the second outboard motor 2*b* does not include the ECU 7*b* and the engine 11*b*. That is, the plurality of outboard motors 202 of the marine propulsion system 200 include an engine outboard motor and an electric outboard motor. The plurality of outboard motors 202 include a first outboard motor 202*a* and a second outboard motor 202*b*. The first outboard motor 202*a* is the engine outboard motor, and the second outboard motor 202*b* is the electric outboard motor. A vessel 1*a* including the marine propulsion system 200 can be driven by a combination of the engine outboard motor and the electric outboard motor. Note that one of the first outboard motor 202*a* or the second outboard motor 202*b* may be an inboard motor or an inboard/outboard motor.

The first outboard motor 202*a* includes a propeller shaft 201*a* to which the driving force of the engine 11*a* is transmitted. The second outboard motor 202*b* includes a propeller shaft 201*b* to which the driving force of the electric motor 12*b* is transmitted. The controller 206*a* puts a limitation on the output of the engine 11*a* when the electric motor 12*b* is not being driven. The controller 206*a* may put a limitation on the output of the engine 11*a* in a state where the controller 206*a* is incommunicable with the controller 206*b*. Alternatively, the controller 206*a* may put a limitation on the output of the engine 11*a* in a state where the electric circuit 8*b* is not supplied with electric power. The control process shown in FIGS. 4 to 7 can be applied to the marine propulsion system 200. In this case, for example, in step S101, step S301, and step S401, the controller 206*a* determines whether or not the controller 206*a* is incommunicable with another controller (herein, the controller 206*b*). In step S306, the controller 206*a* determines whether or not another electric circuit (herein, the electric circuit 8*b*) is not being supplied with electric power. In step S406, the controller 206*a* determines whether or not another electric motor (herein, the electric motor 12*b*) is not being driven.

Figure 9:
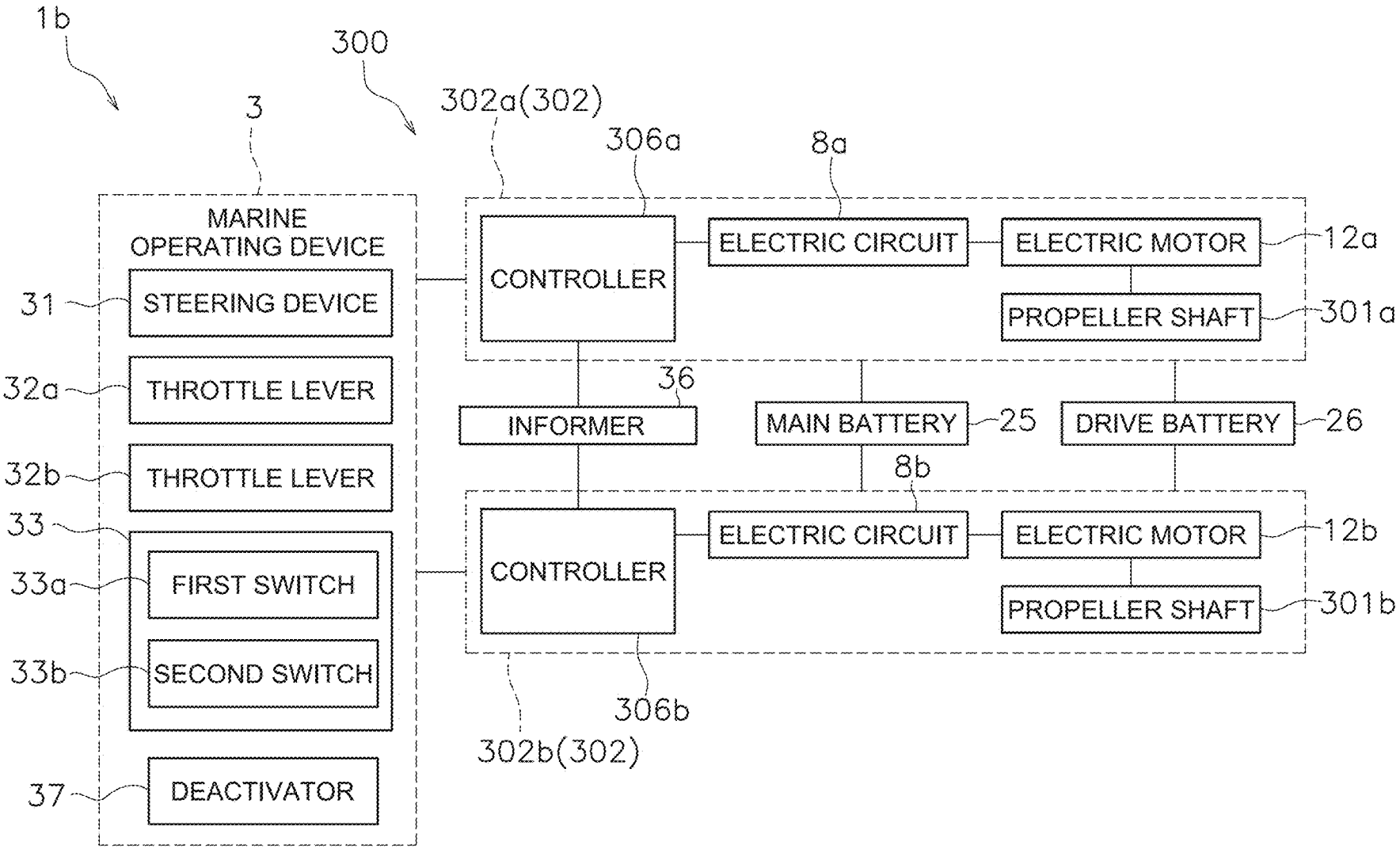
FIG. 9 is a block diagram showing a configuration of the marine propulsion system according to a fifth preferred embodiment of the present invention.

FIG. 9 is a block diagram showing a configuration of a marine propulsion system 300 according to a fifth preferred embodiment. The marine propulsion system 300 has the same configuration as the marine propulsion system 100, except that the first outboard motor 2*a* does not include the ECU 7*a* and the engine 11*a*, and the second outboard motor 2*b* does not include the ECU 7*b* and the engine 11*b*. That is, the marine propulsion system 300 includes a plurality of electric outboard motors. The plurality of outboard motors 302 include a first outboard motor 302*a* and a second outboard motor 302*b*. The first outboard motor 302*a* and the second outboard motor 302*b* are electric outboard motors. In a vessel 1*b* including the marine propulsion system 300, the plurality of electric outboard motors generates a thrust to propel the vessel 1*b*.

The first outboard motor 302*a* includes a propeller shaft 301*a* to which the driving force of the electric motor 12*a* is transmitted. The second outboard motor 302*b* includes a propeller shaft 301*b* to which the driving force of the electric motor 12*b* is transmitted. The controller 306*a* puts a limitation on the output of the electric motor 12*a* when the electric motor 12*b* is not being driven. The controller 306*a* may put a limitation on the output of the electric motor 12*a* in the driving state in a state where the controller 306*a* is incommunicable with the controller 306*b*. Alternatively, the controller 306*a* may put a limitation on the output of the electric motor 12*a* in a state where the electric circuit 8*b* is not supplied with electric power. The control process shown in FIGS. 4 to 7 can be applied to the marine propulsion system 300. In this case, for example, in step S101, step S301, and step S401, the controller 306*a* determines whether or not the controller 306*a* is incommunicable with another controller (herein, the controller 306*b*). In step S306, the controller 306*a* determines whether or not another electric circuit (herein, the electric circuit 8*b*) is not being supplied with electric power. In step S406, the controller 306*a* determines whether or not another electric motor (herein, the electric motor 12*b*) is not being driven. In step S102, step S302, and step S402, the controller 306*a* puts a limitation on the output of the electric motor 12*a* in the driving state.

Preferred embodiments of the present invention have been explained above. However, the present invention is not limited to the preferred embodiments described above, and a variety of changes can be made without departing from the gist of the present invention. For example, the configuration of the outboard motor 2 and/or that of the marine operating device 3 may be changed without being limited to those in the preferred embodiments described above.

In the preferred embodiments described above, the plurality of outboard motors 2 include two outboard motors 2, i.e., the first and second outboard motors 2*a* and 2*b*. Alternatively, the plurality of outboard motors 2 may include three or more outboard motors. For example, the plurality of outboard motors 2 may further include another outboard motor 2 (hereinafter referred to as "third outboard motor") located between the first and second outboard motors 2*a* and 2*b*. In this configuration, the controller 6*a* puts a limitation on the output of the engine 11*a* or the electric motor 12*a* when it is incommunicable with either the controller 6*b* or a controller in the third outboard motor. Additionally, the controller 6*a* cancels the limitation put on the output of the engine 11*a* or the electric motor 12*a* when it is communicable with both the controller 6*b* and the controller in the third outboard motor. It should be noted that each of the controller 6*b* and the controller in the third outboard motor also executes a series of processes similar to the series of processes executed by the controller 6*a*. For example, when the controllers 6*a* and 6*b* are communicable with each other but only the controller in the third outboard motor is incommunicable therewith, the controller 6*a* limits the output of the engine 11*a* or the electric motor 12*a* while the controller 6*b* limits the output of the engine 11*b* or the electric motor 12*b*.

Similarly in the second and third preferred embodiments of the present invention, the controller 6*a* puts a limitation on the output of the engine 11*a* when the controller 6*a* is incommunicable with either the electric circuit 8*b* in the second outboard motor 2*b* or an electric circuit in the third outboard motor, or alternatively, when either the engine 11*b* in the second outboard motor 2*b* or an engine in the third outboard motor is not being driven. Contrarily, the controller 6*a* cancels the limitation put on the output of the engine 11*a* when transitioning from a condition that the controller 6*a* is incommunicable with either the electric circuit 8*b* in the second outboard motor 2*b* or the electric circuit in the third outboard motor to a condition that both the electric circuit 8*b* in the second outboard motor 2*b* and the electric circuit in the third outboard motor are being supplied with electric power. Likewise, the controller 6*a* cancels the limitation put on the output of the engine 11*a* when transitioning from a condition that either the engine 11*b* in the second outboard motor 2*b* or the engine in the third outboard motor is not being driven to a condition that both the engine 11*b* in the second outboard motor 2*b* and the engine in the third outboard motor are being driven.

In the preferred embodiments described above, the main battery 25 is provided to supply electric power to the first and second outboard motors 2*a* and 2*b*. Alternatively, batteries may be provided in correspondence to the first and second outboard motors 2*a* and 2*b*, respectively. As another alternative, the drive battery 26 does not have to be provided, and the main battery 25 may also function as the drive battery 26.

In the preferred embodiments described above, the power transmission 13*a* is configured to transmit mechanical power to the propeller shaft 10*a* from either one of the engine 11*a* and the electric motor 12*a*. Alternatively, the power transmission 13*a* may transmit both mechanical power of the engine 11*a* and that of the electric motor 12*a*.

In the series of control processes to be executed by the controller 6*a* according to the third preferred embodiment, the process of step S401 may be omitted. In this case, the controllers 6*a* and 6*b* may not be communicable with each other. For example, the controller 6*a* may determine that the engine 11*b* is not being driven based on an operating signal transmitted thereto from the marine operating device 3.

In the fourth preferred embodiment, either the first outboard motor 202*a* or the second outboard motor 202*b* may have the same configuration as the first outboard motor 2*a* or the second outboard motor 2*b*. That is, the marine propulsion system may include the first outboard motor 2*a* and the second outboard motor 202*b*, or may include the first outboard motor 202*a* and the second outboard motor 2*b*.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine propulsion system comprising:

a first marine propulsion device including an engine, a first propeller shaft to receive a driving force from the engine, and a first controller configured or programmed to control the engine; and a second marine propulsion device including an electric motor, a second propeller shaft to receive a driving force from the electric motor, an electric circuit connected to the electric motor to drive the electric motor, and a second controller configured or programmed to control the electric motor; wherein the first controller is configured or programmed to put a limitation on an output of the engine when the electric motor is not being driven.

2. The marine propulsion system according to claim 1, wherein the first controller is communicable with the second controller in a communicable state, but when the first controller is incommunicable with the second controller in the communicable state, the first controller puts the limitation on the output of the engine.

3. The marine propulsion system according to claim 2, wherein the first controller is configured or programmed to cancel the limitation on the output of the engine when the first controller becomes communicable with the second controller.

4. The marine propulsion system according to claim 1, wherein the first controller is configured or programmed to put the limitation on the output of the engine such when the electric circuit is not being supplied with electric power.

5. The marine propulsion system according to claim 4, wherein the first controller is configured or programmed to cancel the limitation on the output of the engine when transitioning from the electric circuit not being supplied with electric power to the electric circuit being supplied with electric power.

6. The marine propulsion system according to claim 1, further comprising:

a battery to supply electric power to the electric circuit and the second controller; and a switch to connect or disconnect the battery and both the electric circuit and the second controller to or from each other.

7. The marine propulsion system according to claim 1, further comprising:

an informer to inform a watercraft operator that a state of the limitation on the output of the engine is being activated by the first controller.

8. A marine vessel comprising:

the marine propulsion system according to claim 1.

9. A marine propulsion system comprising:

a plurality of marine propulsion devices each including an electric motor, a propeller shaft to receive a driving force from the electric motor, an electric circuit connected to the electric motor to drive the electric motor, and a controller configured or programmed to control the electric motor; wherein in each of the plurality of marine propulsion devices, the controller is configured or programmed to put a limitation on an output of the electric motor that is in a driving state when an electric motor in any other of the plurality of marine propulsion devices is not being driven.

10. The marine propulsion system according to claim 9, wherein the controllers in the plurality of marine propulsion devices are communicable with each other when in a communicable state; and when the controller in each of the plurality of marine propulsion devices is in the communicable state, but one of the controllers is incommunicable with any other of the controllers, the controller that is being supplied with electric power is configured or programmed to put a limitation on an output of the electric motor controlled by the controller that is being supplied with electric power.

11. The marine propulsion system according to claim 10, wherein the controller that is being supplied with electric power is configured or programmed to cancel the limitation on the output of the electric motor when the controller that is being supplied with electric power becomes communicable with all others of the controllers of the plurality of marine propulsion devices.

12. The marine propulsion system according to claim 9, wherein in each of the plurality of marine propulsion devices, the controller is configured or programmed to put the limitation on the output of the electric motor when the electric circuit in any other of the plurality of marine propulsion devices is not being supplied with electric power.

13. The marine propulsion system according to claim 12, wherein in each of the plurality of marine propulsion devices, the controller is configured or programmed to cancel the limitation on the output of the electric motor when transitioning from the electric circuit in the any other of the plurality of marine propulsion devices not being supplied with electric power to the electric circuits in all of the plurality of marine propulsion devices being supplied with electric power.

14. The marine propulsion system according to claim 9, further comprising:

a battery to supply electric power to the plurality of marine propulsion devices; wherein at least one of the plurality of marine propulsion devices includes a switch to connect or disconnect the battery and both the electric circuit and the controller to or from each other.

15. The marine propulsion system according to claim 9, further comprising:

an informer to inform a watercraft operator that an output limited state is being activated by the controller that is incommunicable to put the limitation on the output of the electric motor controlled by the controller that is incommunicable.

16. A marine vessel comprising:

the marine propulsion system according to claim 9.

17. A method of controlling a marine propulsion system, the marine propulsion system including a first marine propulsion device and a second marine propulsion device, the first marine propulsion device including an engine, a first propeller shaft to receive a driving force from the engine, and a first controller configured or programmed to control the engine, the second marine propulsion device including an electric motor, a second propeller shaft to receive a driving force from the electric motor, an electric circuit connected to the electric motor to drive the electric motor, and a second controller configured or programmed to control the electric motor, the method comprising:

determining whether or not the electric motor is being driven; and putting a limitation on an output of the engine when the electric motor is not being driven.

18. The method according to claim 17, further comprising:

determining whether or not the first controller is communicable with the second controller; and putting the limitation on the output of the engine when the first controller is incommunicable with the second controller.

19. A method of controlling a marine propulsion system, the marine propulsion system including a plurality of marine propulsion devices each including an electric motor, a propeller shaft to receive a driving force from the electric motor, an electric circuit connected to the electric motor to drive the electric motor, and a controller configured or programmed to control the electric motor, the method comprising:

determining whether or not the electric motors of the plurality of marine propulsion devices are being driven; and putting a limitation on an output of the electric motor that is in a driving state when an electric motor in any other of the plurality of marine propulsion devices is not being driven.

20. The method according to claim 19, further comprising:

determining whether or not the plurality of marine propulsion devices are communicable with each other; and putting a limitation on an output of the electric motor that is being supplied with electric power when one of the plurality of marine propulsion devices is incommunicable with any other of the plurality of marine propulsion devices.

21. A marine propulsion system comprising:

a first marine propulsion device including a first motor, a first propeller shaft to receive a driving force from the first motor, and a first controller configured or programmed to control the first motor; and a second marine propulsion device including a second motor, a second propeller shaft to receive a driving force from the second motor, and a second controller configured or programmed to control the second motor; wherein the first controller is configured or programmed to put a limitation on an output of the first motor when the second motor is not providing the driving force.

22. The marine propulsion system according to claim 21, wherein the first motor includes an engine, and the second motor includes an electric motor.

23. The marine propulsion system according to claim 22, wherein the first motor includes the engine and an electric motor, and the second motor includes the electric motor and an engine.

24. The marine propulsion system according to claim 21, wherein the first motor includes an electric motor and the second motor includes an electric motor.

25. The marine propulsion system according to claim 24, wherein the first motor includes the electric motor and an engine, and the second motor includes the electric motor and an engine.

* * * * *